US007296876B2

(12) United States Patent
Kagami et al.

(10) Patent No.: US 7,296,876 B2
(45) Date of Patent: Nov. 20, 2007

(54) HOLDER FOR LIQUID ABSORBER AND LIQUID EJECTING APPARATUS INCORPORATING THE SAME

(75) Inventors: Kazuyuki Kagami, Okaya (JP); Kazuma Ozaki, Okaya (JP); Atsushi Sumii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/589,825

(22) Filed: Oct. 31, 2006

(65) Prior Publication Data

US 2007/0097171 A1 May 3, 2007

(30) Foreign Application Priority Data

Oct. 31, 2005 (JP) ..... P2005-316625

(51) Int. Cl.
*B41J 2/165* (2006.01)

(52) U.S. Cl. ..... 347/36; 347/31; 347/35

(58) Field of Classification Search ..... 347/36, 347/31, 35

See application file for complete search history.

(56) References Cited

U.S. PATENT DOCUMENTS 5,291,227 A * 3/1994 Suzuki ..... 347/104
6,239,817 B1 * 5/2001 Meyer ..... 347/36
6,805,440 B2 * 10/2004 Otsuki ..... 347/104
6,860,583 B2 * 3/2005 Cheney et al. ..... 347/35
6,886,909 B2 * 5/2005 Ogasawara ..... 347/35
7,011,389 B2 * 3/2006 Edamura et al. ..... 347/36
7,204,577 B2 * 4/2007 Kanamitsu et al. ..... 347/31

FOREIGN PATENT DOCUMENTS

| | | |
|---|---|---|
| JP | 2003-118181 | 4/2003 |
| JP | 2004-155109 | 6/2004 |
| JP | 2005-144914 | 6/2005 |
| JP | 2005-170590 | 6/2005 |
| JP | 2005-288748 | 10/2005 |
| JP | 2005-289539 | 10/2005 |

* cited by examiner

*Primary Examiner*—Shih-Wen Hsieh
(74) *Attorney, Agent, or Firm*—Sughrue Mion, PLLC

(57) ABSTRACT

A liquid ejecting head is operable to eject liquid toward a target medium. A medium supporting member is opposing to the liquid ejecting head and supporting the target medium from below. A liquid absorber is adapted to receive and absorb liquid ejected to the outside of the target medium. A holder is holding the liquid absorber and being detachably provided with the medium supporting member.

9 Claims, 7 Drawing Sheets

HOLDER FOR LIQUID ABSORBER AND LIQUID EJECTING APPARATUS INCORPORATING THE SAME

BACKGROUND

1. Technical Field

The present invention relates to a liquid ejection apparatus adapted to eject liquid on a target medium supported on a platen, and relates to a holder for a liquid absorber incorporated in the platen.

2. Related Art

For example, as an ink jet printer serving as a liquid ejecting apparatus, there is a type which performs printing without remaining any margin on the entire surface of sheet serving as a target medium, that is, which can execute a so-called marginless printing. In such an ink jet printer, a platen which supports paper and defines the position of the paper with respect to a printing head is provided with recesses for discarding ink droplets ejected outside of the edges of the paper. An ink absorber made of material such as polypropylene in a sponge state, which is high in porosity and good in ink absorbability, is integrally attached into the recesses for discarding ink. Such a configuration is disclosed in, for example, Japanese Patent Publication No. 2004-155109A (JP-A-2004-155109).

In the aforesaid ink jet printer, an amount of ink capable of being absorbed into the ink absorber is limited. Thus, when the absorbed amount of the ink reaches the limited value, the ink absorber is required to be replaced. In this case, since the ink absorber is integrally attached to the platen, it is required to replacement the platen entirely. However, it is difficult to make the state of the platen after the replacement coincide completely with the state of the platen before the replacement, and so the printing state may change between the state before the replacement and the state after the replacement.

SUMMARY

It is therefore one advantage of some aspect of the invention to provide a liquid ejection apparatus which can prevent the change of a liquid ejection state with respect to a target medium between states before and after the replacement of ink absorber.

According to one aspect of the invention, there is provided a liquid ejecting apparatus, comprising:

a liquid ejecting head, operable to eject liquid toward a target medium which is transported in a first direction;

a medium supporting member, opposing to the liquid ejecting head and supporting the target medium from below;

a liquid absorber, adapted to receive and absorb liquid ejected to the outside of the target medium; and a holder, holding the liquid absorber and being detachably provided with the medium supporting member.

The medium supporting member may be formed with an opening. The holder may be detachably provided in the opening.

The liquid ejecting apparatus may further comprise: a first engagement member, provided in the opening at a position located in an upstream side relative to the first direction; and a second engagement member, provided on the holder and adapted to be engaged with the first engagement member.

The liquid ejecting apparatus may further comprise a projection, provided on the holder and adapted to be brought into slide contact with an inner wall face of the opening.

The liquid ejecting apparatus may further comprise a liquid leading member, provided on the liquid absorber and adapted to lead the liquid downward. A through hole may be adapted to allow the liquid leading member to extend therethrough is formed at a bottom part of the opening.

The bottom part of the opening may slope toward the through hole.

At least a part of a bottom face of the holder opposing the bottom part of the opening may slope toward the liquid leading member.

According to one aspect of the invention, there is also provided a liquid absorber holder, adapted to be incorporated in an liquid ejecting apparatus which comprises: a liquid ejecting head, operable to eject liquid toward a target medium, and a medium supporting member, opposing to the liquid ejecting head and supporting the target medium from below. The liquid absorber holder comprises:

a liquid absorber, adapted to receive and absorb liquid ejected to the outside of the target medium; and a holder body, holding the liquid absorber and adapted to be detachable with respect to the medium supporting member.

According to one aspect of the invention, there is also provided a method of replacing a liquid absorber provided in a liquid ejecting apparatus which comprises: a liquid ejecting head, operable to eject liquid toward a target medium; a medium supporting member, opposing to the liquid ejecting head and supporting the target medium from below; a first holder holding a first liquid absorber which is adapted to receive and absorb liquid ejected to the outside of the target medium, and detachably provided with the medium supporting member. The method comprises:

detaching the first holder from the medium supporting member;

providing a second holder holding a second liquid absorber which is adapted to receive and absorb liquid ejected to the outside of the target medium; and attaching the second holder to the medium support member.

DETAILED DESCRIPTION OF EXEMPLARY EMBODIMENTS

Exemplary embodiments of the invention will be described below in detail with reference to the accompanying drawings.

According to one embodiment of the invention, there will be described an ink jet printer 100 adapted to perform printing with ink on a sheet of paper of a size such as L/2L size (for photograph), a postcard size, a JIS A4 size or an extended JIS A3 size (also referred to as an A3 plus size or a super B size) or a JIS A2 size.

Figure 1:
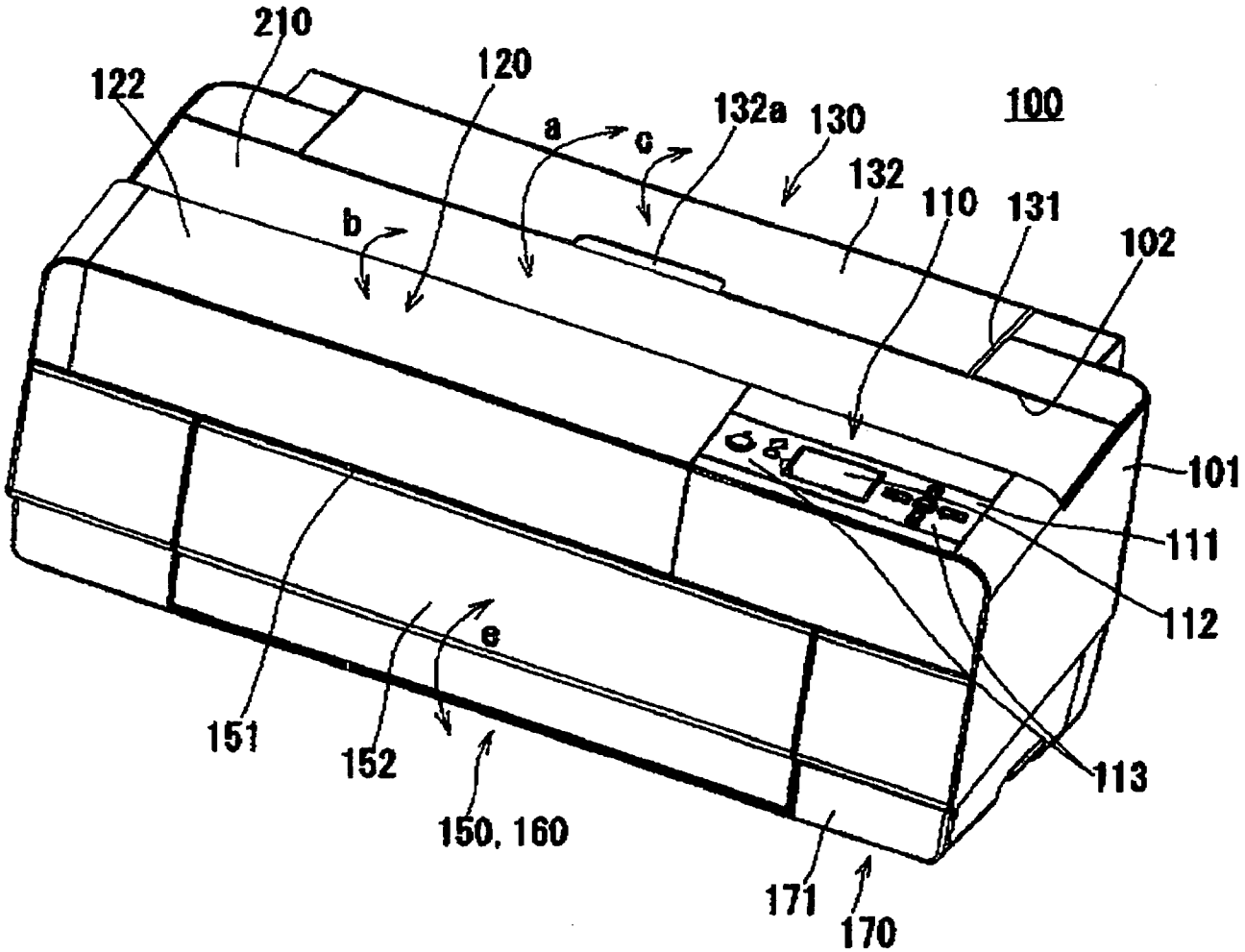
FIG. 1 is a perspective front view of a printer according to one embodiment of the invention.
Figure 2:
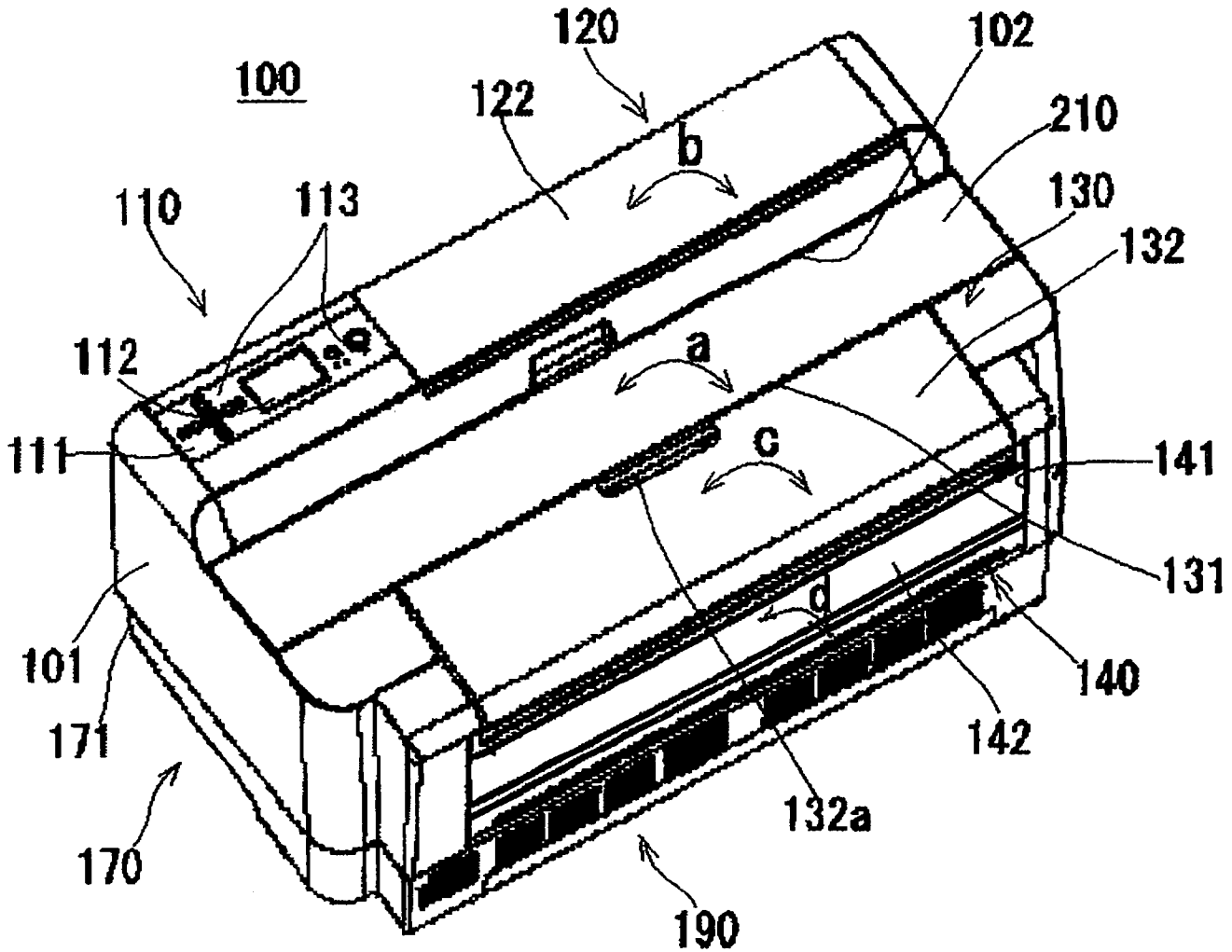
FIG. 2 is a perspective rear view of a printer according to one embodiment of the invention.
Figure 3:
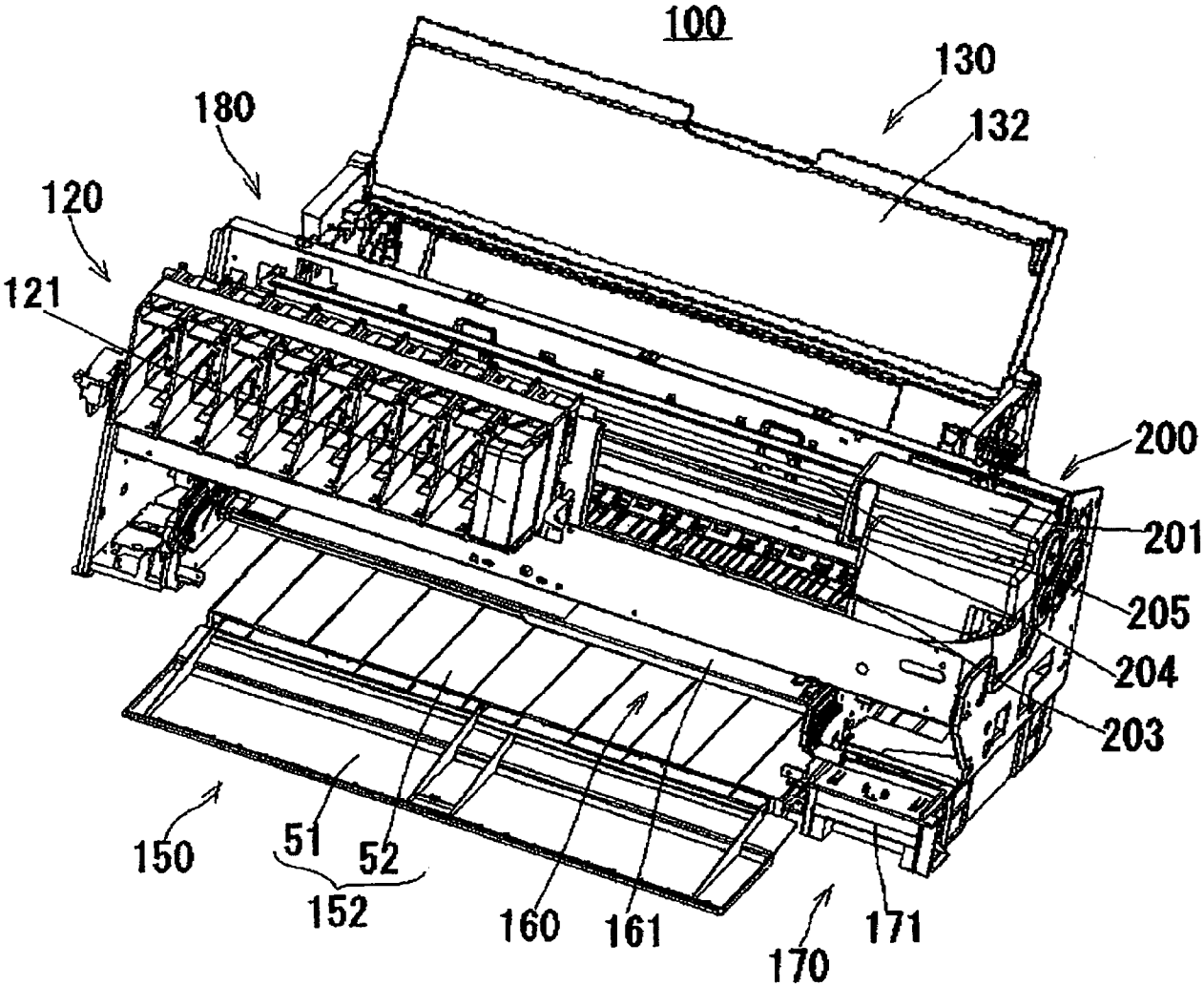
FIG. 3 is a perspective front view showing an internal configuration of the printer.
Figure 4:
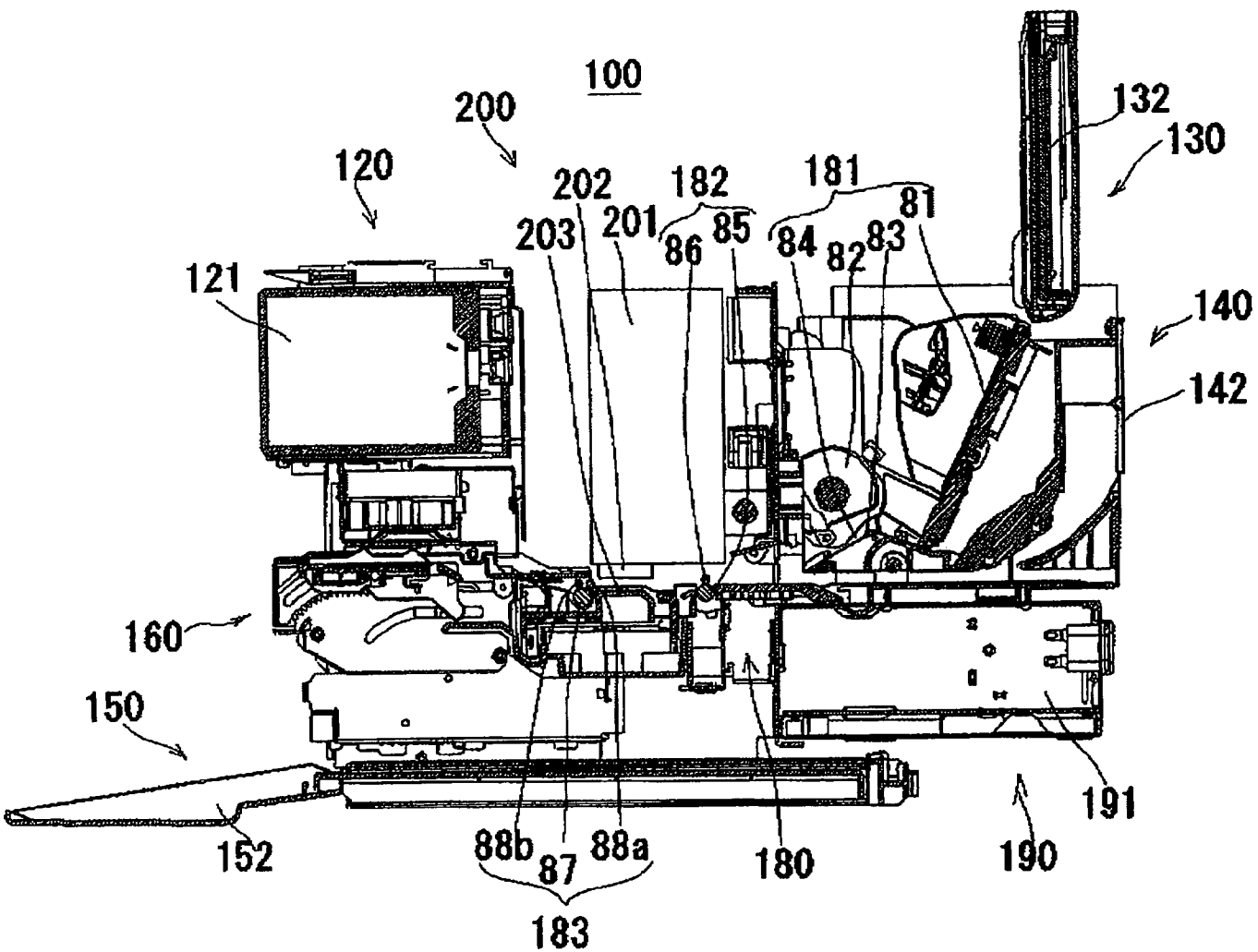
FIG. 4 is a section view showing the internal configuration of the printer.
Figure 5:
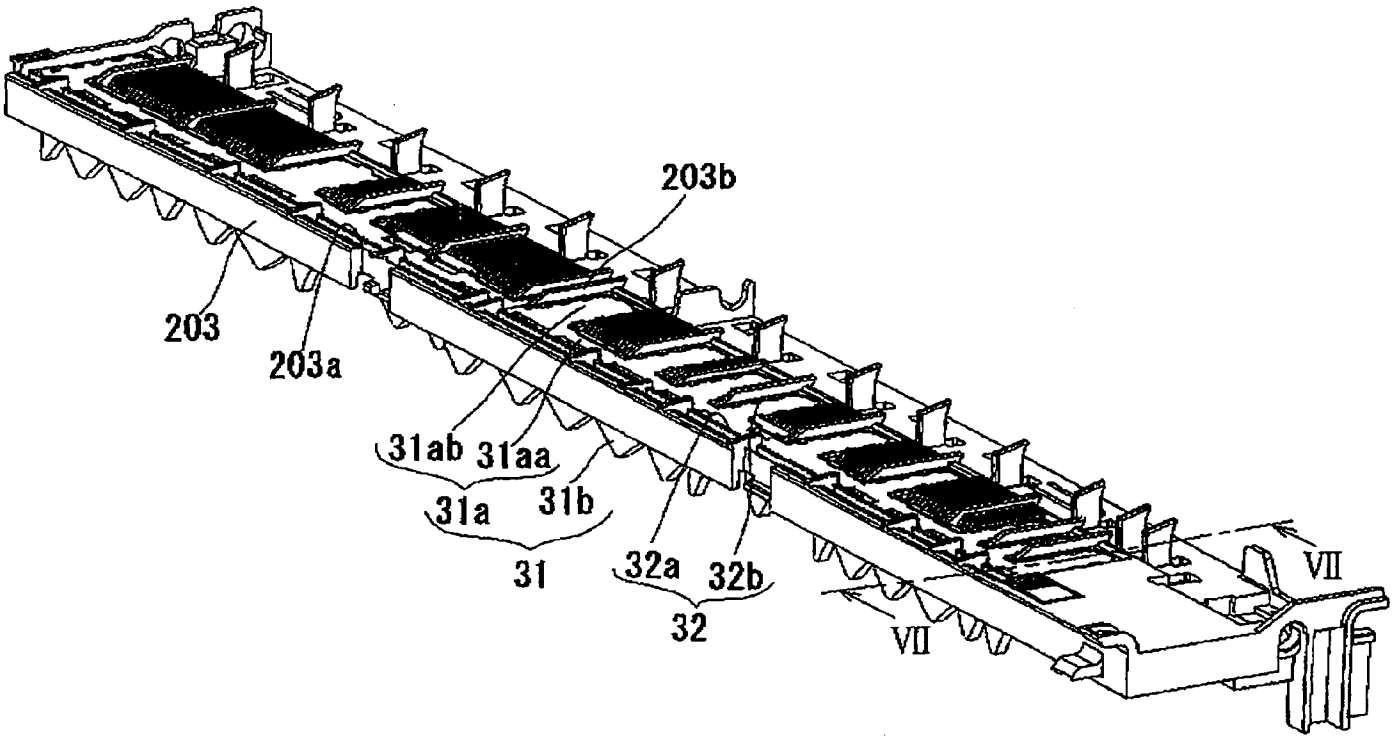
FIG. 5 is a perspective view of a platen in the printer.
Figure 6:
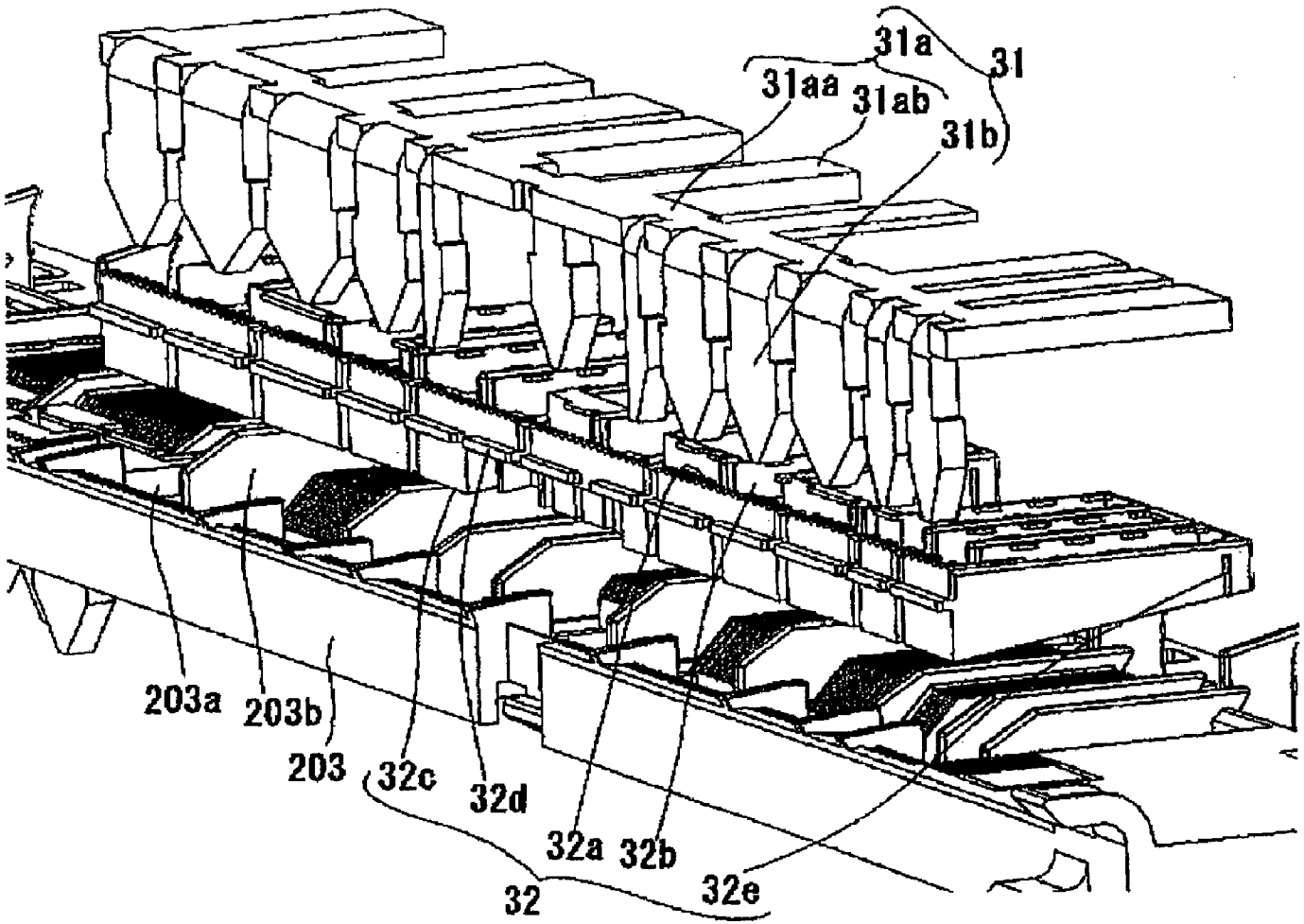
FIG. 6 is a perspective view of the platen showing a disassembled state thereof.
Figure 7:
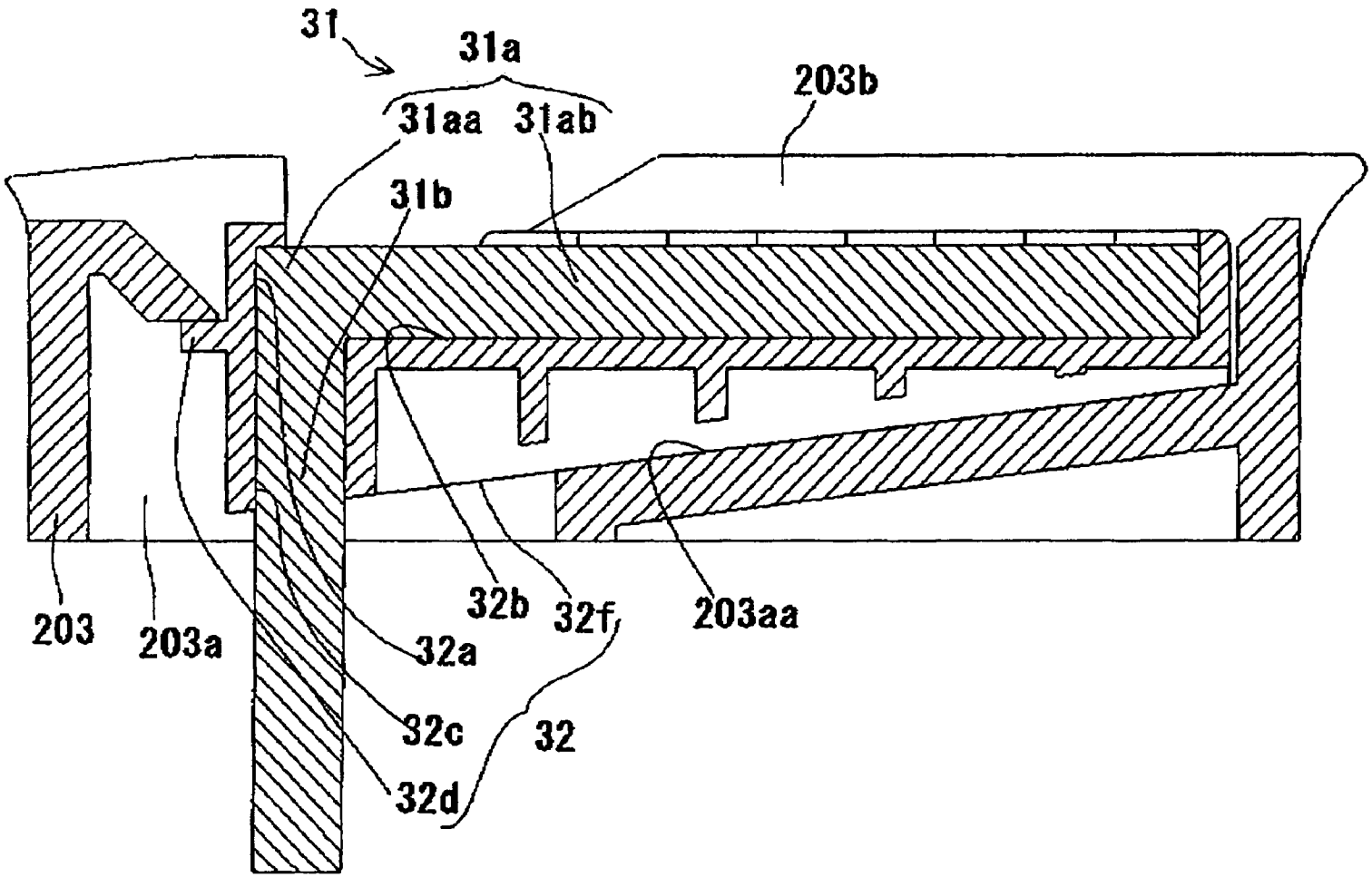
FIG. 7 is a section view taken along a line VII-VII in FIG. 5.

As shown in FIGS. 1 and 2, the ink jet printer 100 is covered by a housing 101 of an almost rectangular parallelepiped in its entirety. An control panel 110 is provided on the right front side of the upper face of the housing 101. A cartridge housing section 120 is provided on the left front side of the upper face of the housing. A first rear sheet feeding section 130 is provided on the rear side of the upper face of the housing, and a second rear sheet feeding section 140 is provided on the back side of the housing. A sheet ejecting section 150 and a front sheet feeding section 160 are provided on the front side of the housing, and a waste ink recovering section 170 is provided on the right side of the front face of the housing. As shown in FIGS. 2 to 4, there are provided a sheet transporting section 180, a controller 190 and a printing section 200 within the ink jet printer 100.

As shown in FIGS. 1 and 2, an opening 102 of a rectangular shape is formed between the first rear sheet feeding section 130 and the control panel 110, the cartridge housing section 120 on the upper face of the housing 101. The opening 102 is covered by a top cover 210. The top cover 210 is attached so as to be pivotable in directions shown by arrows a in the figures about the pivot shaft at a rear end thereof. When a user lifts the top cover 210 thereby to open the opening 102, the user can easily perform the maintenance operation etc. of the inner mechanism such as the sheet transporting section 180 and the printing section 200 through the opening 102.

As shown in FIGS. 1 and 2, the control panel 110 has an operation panel 111 of an almost rectangular shape. A liquid crystal panel 112 for displaying an operation state etc. is provided at the almost center portion of the operation panel 111. On the both sides of the liquid crystal panel 112, there are provided buttons 113 such as a button for a power system for turning on and off a power source, a button for an operation system for performing the heading of paper etc. and performing the flushing of ink etc., and a button for a processing system for performing an image processing etc. A user can operate the buttons 113 while seeing and confirming the liquid crystal panel 112, so that an erroneous operation can be prevented from occurring.

As shown in FIGS. 1 and 2, in the cartridge housing section 120, ink cartridges 121 shown in FIGS. 3 and 4 for reserving various colors of printing ink (9 colors in this example) are removably housed. The ink cartridge 121 is covered by a cartridge cover 122 having an L-shaped cross section. The cartridge cover 122 is attached so as to be pivotable in directions shown by arrows b in the figures about the pivot shaft at the rear end thereof. When a user lifts the cartridge cover 122 thereby to open the cartridge housing section 120, the user can easily replacement the ink cartridge 121 and so on, so that the operation efficiency can be improved.

The first rear sheet feeding section 130 is used for the automatic sheet feeding (ASF) and, as shown in FIGS. 1 and 2, includes a first sheet support 132 having four stage structure which has a function of supporting one or more sheets to be fed as well as a function of opening and closing a first sheet feeding port 131 opened in a rectangular shape upward. The first sheet support 132 is attached so as to be pivotable in directions shown by arrows c in the figures about the pivot shaft at the rear end thereof.

Before using the ink jet printer 100 a user hooks the finger into a hole 132*a* provided at the center portion of the front side of the first sheet support 132 and lifts the first sheet support 132 to draw out the multi-stage portion thereby to complete the setting operation. Thus, the keeping or management etc., which is necessary in the case of sheet support of a detachable type, is not required in this case. Further, since the first sheet support 132 has the multi-stage structure, various sizes of sheets to be fed can be surely supported. After using the ink jet printer 100, when the multi-stage portion of the first sheet support 132 is pushed in, the first sheet feeding port 131 is closed. Thus, dust is prevented from entering into the main body of the printer and the first sheet support 132 can be housed in a compact size.

The second rear sheet feeding section 140 is used for the manual sheet feeding and, as shown in FIG. 2, includes a second sheet support 142 of two stage structure which has a function of supporting a sheet to be fed as well as a function of opening and closing a second sheet feeding port 141 opened in a rectangular shape backward. The second sheet support 142 is attached so as to be pivotable in directions shown by arrows d in the figure about the pivot shaft at the lower end thereof. Sheets fed from the second rear sheet feeding section 140 are ones each having a relatively thin thickness such as plain paper.

Before using the ink jet printer 100, a user hooks the finger with the upper portion of the second sheet support 142 shown in the figure and pushes the second sheet support 142 down to draw out the multi-stage portion thereby to complete the setting operation. Thus, the keeping or management etc., which is necessary in the case of the sheet support of the detachable type, is not required in this case. Further, since the second sheet support 142 has the multi-stage structure, sheets of various sizes to be fed can be surely supported. After using the ink jet printer 100, when the multi-stage portion of the second sheet support 142 is pushed in and the first sheet support is closed, the second sheet feeding port 141 can be closed. Thus, dust is prevented from entering into the main body of the printer and the second sheet support 142 can be housed in a compact size.

The sheet ejecting section 150 includes a stacker 152 of a two-stage structure having a first stacker 51 and a second stacker 52 each of which has a function of stacking one or more sheets to be ejected as well as a function of opening and closing a sheet ejecting port 151 opened in a rectangular shape in the forward direction. The first stacker 51 is attached so as to be pivotable in directions shown by arrows e in the figure about the pivot shaft at the tip end side of the second stacker 52. The second stacker 52 is attached so as to move obliquely in the vertical direction and in parallel to the sheet ejecting port 151 thereby to be able to protrude and be housed.

Before using the ink jet printer 100, a user hooks the finger with the upper portion of the first stacker 51 to pivot the first stacker 51 in the front direction thereby to open the sheet ejecting port 151, then draws out the first stacker 51 to move the second stacker 52 obliquely upward in parallel to the sheet ejecting port to protrude the second stacker, thereby completing the setting operation. Thus, the keeping or management etc., which is necessary in the case of a stacker of a detachable type, is not required in this case. Further, since the stacker 152 has the multi-stage structure, various sizes of sheets to be ejected can be surely placed in a stacked manner. Furthermore, since sheets having been subjected to the printing are always ejected from the front face side, a user can easily take the sheets out. After using the ink jet printer 100, when a user pushes in the tip end of the first stacker 51 by the hand, the second stacker 52 is moved obliquely downward in parallel to the sheet ejecting port and housed. Further, when the first stacker 51 is pivoted backward by putting a hand on the first stacker 51, the sheet ejecting port 151 can be closed. Thus, dust is prevented from entering into the main body of the printer and the stacker 152 can be housed in a compact size.

The front sheet feeding section 160 is used for the manual sheet feeding and, as shown in FIG. 3, includes a sheet feeding tray 161 provided above the stacker 152 at the sheet ejecting port 151. The sheet feeding tray 161 is provided so as to be movable in the horizontal direction and in parallel to the sheet ejecting port 151. Sheets fed from the front sheet feeding section 160 are ones each having a relatively large thickness such as mat paper which can not be bent at the time of transport.

Before using the ink jet printer 100, when a user slightly pushes in the tip end of the sheet feeding tray 161, the stopper of the sheet feeding tray 161 is disengaged and so the sheet feeding tray 161 protrudes from the sheet ejecting port 151. After using the ink jet printer 100, when the tip end of the sheet feeding tray 161 is pushed in slightly, the stopper of the sheet feeding tray 161 is engaged and so the sheet feeding tray 161 is housed within the sheet ejecting port 151. Thus, the housing efficiency for disposing the sheet feeding tray 161 can be enhanced.

As shown in FIGS. 1 to 3, a waste ink tank 171 for reserving waste ink etc. is removably housed in the waste ink recovering section 170. The waste ink tank 171 reserves waste ink etc. which is discarded at the time of cleaning the printing head 202 and replacing an ink cartridge. When the waste ink tank 171 is filled with the waste ink etc., a user is merely required to draw the waste ink tank 171 out and insert a new waste ink tank 171. Thus, the replacement operation of the waste ink tank 171 can be performed easily.

As shown in FIGS. 3 and 4, the sheet transporting section 180 is provided over an area from the first rear sheet feeding section 130, the second rear sheet feeding section 140 to the sheet ejecting section 150 and includes an automatic sheet feeding mechanism 181, a transporting mechanism 183 and sheet ejecting mechanism 183. As shown in FIG. 4, the automatic sheet feeding mechanism 181 includes, for example, a hopper 81 for lifting sheets supported by the first sheet support 132 in order to feed the sheets, a sheet feeding roller 82 for taking out the sheets lifted by the holler 81, a retard roller 83 for separating only one paper from the sheets fed together by the sheet feeding roller 82, and a sheet returning lever 84 for returning the remaining sheets thus separated by the retard roller 83.

The hopper 81 is formed in a flat shape so that sheets can be placed thereon and is provided almost in parallel to the rear wall. The hopper is provided in a manner that the lower end thereof is positioned near the sheet feeding roller 82 and the upper end thereof is positioned near the top portion of the rear wall. Further, the hopper 81 is provided in a manner that the other end of a not-shown compression spring which one end is attached to the rear wall is attached to the rear face of the lower end side thereof, whereby the lower end side pivots about the upper end side in accordance with the expansion/compression of the compression spring.

The sheet feeding roller 82 having a D-shaped cross section is provided near the lower end of the hopper 81. The sheet feeding roller 82 rotates intermittently to feed with friction the sheets lifted by the hopper 81. The retard roller 83 is provided so as to be able to abut against the sheet feeding roller 82 and acts to separate with friction only the uppermost paper from the sheets fed together by the sheet feeding roller 82. The sheet returning lever 84 is formed in a nail shape and is provided near the sheet feeding roller 82. The sheet returning lever hooks by the nail the remaining sheets separated by the retard roller 83 and returns the remaining sheets to the hopper 81.

As shown in FIG. 4, the transporting mechanism 183 is provided with a sheet transporting roller 85 which transports a sheet in a secondary scanning direction (the lateral direction in this figure) in synchronism with the printing operation and a follower roller 86 etc. The sheet transporting roller 85 is provided in the upstream side of the sheet transporting path of the platen 203 and acts to hold, together with the follower roller 86, the sheet fed by the sheet feeding roller 82 and to transport the sheet to the platen 203.

As shown in FIG. 4, the sheet ejecting mechanism 183 includes a sheet ejecting roller 87, a first spur roller 88*a*, a second spur roller 88*b* etc. The first spur roller 88*a* is provided in the downstream side of the sheet transporting path of the platen 203, whist the second spur roller 88*b* and the sheet ejecting roller 87 are provided in an opposed manner in the downstream side of the sheet transporting path of the first spur roller 88*a*. First, the first spur roller 88*a* ejects the sheet passed through the platen 203, and then the second spur roller 88*b* and the sheet ejecting roller 87 hold the sheet thus ejected and eject the sheet on the stacker 152. The first spur roller 88*a* and the second spur roller 88*b* are held by a not-shown same holding member.

As shown in FIG. 4, the controller 190 includes a main board 191 constituting a printer controller. On the main board 191, there are provided a control element and a memory element such as a CPU, a ROM, a RAM, an ASIC and other various kinds of circuit elements, each being not shown, thereby to control the sheet transporting section 180 and the printing section 200 constituting a print engine.

As shown in FIG. 4, in the printing section 200, there are provided a carriage 201 which moves in a primary scanning direction (perpendicular to the secondary scanning direction) in synchronism with the printing operation, the printing head 202 which ejects ink in synchronism with the printing operation, and the platen 203 which supports a sheet in a flat state upon printing. As shown in FIG. 3, the carriage 201 is supported by a carriage guide shaft 204 above the platen 203 and coupled to a carriage belt 205. When a not-shown carriage motor drives the carriage belt 205, the carriage moves reciprocally along the carriage guide shaft 204 in accordance with the movement of the carriage belt 205.

As shown in FIG. 4, the printing head 202 is mounted on the carriage 201 so as to be spaced from the platen 203 by a predetermined distance. The printing head can eject plural kinds of ink (e.g., black, photo black, mat black, yellow, cyan, light cyan, magenta, light magenta, gray and red). That is, the printing head 202 is arranged in a manner that a pressure generating chamber and a nozzle orifice communicating therewith are provided at a nozzle plate, whereby when ink is reserved within the pressure generating chamber and the ink is pressurized with a predetermined pressure, so that an ink droplet having a controlled magnitude is ejected toward a sheet from the nozzle orifice.

The platen (medium supporting member) 203 is provided so as to oppose to the printing head 202 between the sheet transporting roller 85 and the sheet ejecting roller 87 and supports a sheet being transported on the surface thereof. The platen 203 has an elongated plate shape having a width dimension in the primary scanning direction which is slightly greater than the maximum width of a sheet to which printing can be executed. An absorber holder 32 for holding an ink absorber 31 is detachably provided in the platen 203.

The ink absorber 31 includes ink receiving portions 31*a* for receiving and absorbing ink droplets ejected out of the edge of a sheet upon the marginless printing, and ink leading portions 31*b* which are formed integrally with the ink receiving portions 31*a* to lead waste ink absorbed by the ink receiving portions 31*a* to a not-shown waste ink tray provided beneath. The ink receiving portions 31*a* are formed in a pectinated manner. The ink receiving portions 31*a* include extended portions 31*ab* extending in the secondary scanning direction and connecting portions 31*aa* each of which extends in the primary scanning direction and connects adjacent extended portions 31*ab*. The ink leading portions 31*b* are formed in a pectinated manner so as to be almost orthogonal to the extended portions 31*ab* at the connecting portions 31*aa*. As material of such the ink absorber 31, porous material such as polypropylene or polyethylene in a sponge state is used which has a high ink absorbing property and a performance hardly affected by the ink (high ink resistance property) and is excellent in elasticity and flexibility.

The absorber holder 32 is formed so as to be slightly larger than the ink receiving portion 31*a* of the ink absorber 31 and to have: first recesses 32*a* each extending in the primary scanning direction and capable of housing the connecting portion 31*aa* of the ink receiving portion 31*a;* second recesses 32*b* each extending in the secondary scanning direction and capable of housing the extended portion 31*ab* of the ink receiving portion 31*a;* and through holes 32*c* each capable of receiving the tip end of the ink leading portion 31*b*. The absorber holder 32 is provided with projections 32*d* on the front side face of the absorber holder 32 which is in the upstream side of the sheet transporting direction (the secondary scanning direction), and also provided with projections 32*e* on the both side faces thereof in the downstream side of the sheet transporting direction, respectively. The absorber holder 32 is detachable with respect to a recess 203*a* which is formed on the upper face of the platen 203 in the upstream side of the sheet transporting direction and has almost the same shape as the absorber holder 32.

In the case of attaching the absorber holder 32 to the platen 203, first, the absorber holder 32 is inserted into the recess 203*a* of the platen 203 in a state that the front face of the absorber holder 32 is directed downward. Then, the ink leading portion 31*b* of the ink absorber 31 is inserted into a through hole 32*c* perforated at the recess 203*a* and also the projections 32*d* of the absorber holder 32 is engaged with retainers 203*b* formed within the recess 203*a* of the platen 203. Next, the rear side (the downstream side of the sheet transporting direction) of the absorber holder 32 is pushed down within the recess 203*a* of the platen 203 while bringing the fixing projection 32*e* slide contact with the inner side wall of the recess 203*a* of the platen 203 thereby to attach the absorber holder 32 to the platen 203.

On the other hand, in the case of detaching the absorber holder 32 from the platen 203, first, the rear side of the absorber holder 32 is pulled up from the recess 203*a* of the platen 203. Then, the upstream side of the sheet transporting direction of the absorber holder 32 is pulled up obliquely from the recess 203*a* of the platen 203, thereby detaching the absorber holder 32 from the platen 203.

The second recesses 32*b* of the absorber holder 32 respectively attached to the recesses 203*a* of the platen 203 are positioned in parallel to the platen 203 in the upstream side of the sheet transporting direction of the platen 203. The first recesses 32*a* are provided mainly in order to discard ink droplets ejected outside of the leading edge of sheet at the time of performing the marginless printing. The second recesses 32*b* of the absorber holder 32 respectively attached to the recesses 203*a* of the platen 203 are locally provided at the positions corresponding to the left and right side edges of each sheet to which printing is executable. The second recesses 32*b* are provided mainly in order to discard ink droplets ejected outside of the left and right edges of sheet at the time of performing the marginless printing. A plurality of ribs 203*b* each extending to the sheet transporting direction are provided with a predetermined interval on the platen 203 between the second recesses 32*b*. Each of the ribs 203*b* has an almost trapezoidal shape in its section and acts to support a sheet being transported from the rear face side thereof.

The bottom face 203*aa* of each of the recesses 203*a* of the platen 203 is formed so as to slope downward from the downstream side of the sheet transporting direction to the upstream side of the sheet transporting direction, that is, toward the ink leading portion 31*b*. Further, similarly, the bottom faces 32*f* of the absorber holder 32 respectively opposing to the bottom faces 203*aa* of the inclined recesses 203*a* of the platen 203 are also formed so as to slope downward from the downstream side of the sheet transporting direction to the upstream side of the sheet transporting direction, that is, toward the ink leading portion 31*b*. Thus, even ink absorbed in the downstream side of the sheet transporting direction of the ink absorber 31 flows down without being accumulated along the bottom faces 203*aa* of the inclined recesses 203*a* and the bottom faces 32*f* of the absorber holder 32 due to the gravitation, so that almost all waste ink absorbed in the ink absorber 31 can be ejected into the ink recovering tray.

As described above, according to the ink jet printer 100 of this embodiment, the absorber holder 32 holds the ink absorber 31 which receives ink discarded at the time of ejecting ink toward a sheet without remaining any margin on the entire face of the sheet, and the absorber holder 32 is made detachable with respect to the platen 203. Thus, the ink absorber 31 can be replaced without removing the platen 203. Accordingly, the supporting state of sheet transporting on the platen 203 does not change between the state before the replacement of the ink absorber 31 and the state after the replacement thereof, so that the ejection state of ink with respect to the sheet can be maintained.

The absorber holder 32 is fit into and attached to the recess 203*a* formed at the platen 203. This attachment operation is performed in a manner that the upstream side of the sheet transporting direction of the absorber holder 32 is inserted into the recess 203*a* and then the downstream side of the sheet transporting direction thereof is pushed into the recess 203*a*. As a result, the detaching operation of the absorber holder 32 having the ink absorber 31 can be performed easily with respect to the platen 203. Further, since the absorber holder 32 has the projections 32*e* on the both side faces thereof, the positioning of the absorber holder 32 having the ink absorber 31 can be performed reliably with respect to the platen 203.

Further, the ink absorber 31 includes the ink leading portion 31*b* which introduces received ink downward. Since the recess 203*a* is provided with the through hole 32*c* through which the ink leading portion 31*b* can extend downward, a member for reserving ink flowing downward from the ink leading portion 31*b* can be formed beneath the ink absorber 31. Thus, the limit value of an amount of ink capable of being absorbed into the ink absorber can be increased. Further, in the platen 203, the bottom face 203*aa* of each of the recesses 203*a* is sloped toward the ink leading portion 31*b*, and also the bottom faces 32*f* of the absorber holder 32 respectively opposing to the bottom faces 203*aa* of the recesses 203*a* are inclined. Thus, almost all ink absorbed into the ink absorber 31 can be introduced to the ink leading portion 31*b*.

The above advantageous effect can be attained in a case where at least one of the bottom face 203*aa* of each of the recesses 203*a* and the bottom faces 32*f* of the absorber holder 32 is sloped toward the ink leading portion 31*b*.

Although the explanation is made as to the ink jet printer as an example of the liquid ejecting apparatus, the invention can also be applied to a facsimile apparatus, a copying apparatus etc. Further, the invention can be applied not only to the printing apparatus but also to an apparatus provided with a color material ejecting head used for manufacturing color filters for liquid crystal displays etc., an electrode material (conductive paste) ejecting head used for forming the electrodes of organic EL displays or field emission displays (FED) etc., a bio-organic material ejecting head used for manufacturing biochips, a sample ejecting head as an accurate pipette, and so on as the liquid ejection apparatus which ejects liquid from a liquid ejecting head toward a target medium thereby to land the liquid onto the target medium.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2005-316625 filed Oct. 31, 2005 including specification, drawings and claims is incorporated herein by reference in its entirety.

What is claimed is:

1. A liquid ejecting apparatus, comprising:

a liquid ejecting head, operable to eject liquid toward a target medium which is transported in a first direction;

a medium supporting member, opposing to the liquid ejecting head and supporting the target medium from below;

a liquid absorber, adapted to receive and absorb liquid ejected to the outside of the target medium; and a holder, holding the liquid absorber and being detachably provided with the medium supporting member.

2. The liquid ejecting apparatus as set forth in claim 1, wherein:

the medium supporting member is formed with an opening; and the holder is detachably provided in the opening.

3. The liquid ejecting apparatus as set forth in claim 2, further comprising:

a first engagement member, provided in the opening at a position located in an upstream side relative to the first direction; and a second engagement member, provided on the holder and adapted to be engaged with the first engagement member.

4. The liquid ejecting apparatus as set forth in claim 2, further comprising:

a projection, provided on the holder and adapted to be brought into slide contact with an inner wall face of the opening.

5. The liquid ejecting apparatus as set forth in claim 2, further comprising:

a liquid leading member, provided on the liquid absorber and adapted to lead the liquid downward, wherein:

a through hole adapted to allow the liquid leading member to extend therethrough is formed at a bottom part of the opening.

6. The liquid ejecting apparatus as set forth in claim 5, wherein:

the bottom part of the opening slopes toward the through hole.

7. The liquid ejecting apparatus as set forth in claim 5, wherein:

at least a part of a bottom face of the holder opposing the bottom part of the opening slopes toward the liquid leading member.

8. A liquid absorber holder, adapted to be incorporated in an liquid ejecting apparatus which comprises: a liquid ejecting head, operable to eject liquid toward a target medium; and a medium supporting member, opposing to the liquid ejecting head and supporting the target medium from below, the liquid absorber holder comprising:

a liquid absorber, adapted to receive and absorb liquid ejected to the outside of the target medium; and a holder body, holding the liquid absorber and adapted to be detachable with respect to the medium supporting member.

9. A method of replacing a liquid absorber provided in a liquid ejecting apparatus which comprises:

a liquid ejecting head, operable to eject liquid toward a target medium;

a medium supporting member, opposing to the liquid ejecting head and supporting the target medium from below;

a first holder holding a first liquid absorber which is adapted to receive and absorb liquid ejected to the outside of the target medium, and detachably provided with the medium supporting member, the method comprising:

detaching the first holder from the medium supporting member;

providing a second holder holding a second liquid absorber which is adapted to receive and absorb liquid ejected to the outside of the target medium; and attaching the second holder to the medium support member.

* * * * *